US006038803A

United States Patent [19]

Wilkins

[11] Patent Number: 6,038,803

[45] Date of Patent: Mar. 21, 2000

[54] APPARATUS FOR DECORATING PICTURE HOLDERS WITH SEASONAL OR OTHER DISPLAYS

[76] Inventor: Frances Elizabeth Wilkins, P.O. Box 23108, Eugene, Oreg. 97402

[21] Appl. No.: 09/073,649

[22] Filed: May 6, 1998

[51] Int. Cl.[7] ..... G09F 7/12; A47G 1/06

[52] U.S. Cl. ..... 40/773; 40/768; 40/594

[58] Field of Search ..... 40/594, 595, 768, 40/773; 283/64

[56] References Cited

U.S. PATENT DOCUMENTS

| | | | |
|---|---|---|---|
| 4,652,239 | 3/1987 | Brimberg | 40/594 X |
| 4,673,609 | 6/1987 | Hill | 428/187 |
| 4,741,119 | 5/1988 | Baryla | 40/594 |
| 4,863,191 | 9/1989 | Termanis | 283/64 X |
| 4,916,584 | 4/1990 | Gustafson . | |
| 4,992,121 | 2/1991 | Rubino | 40/594 X |
| 5,102,171 | 4/1992 | Saetre . | |
| 5,531,176 | 7/1996 | Johnson | 112/475.24 |
| 5,557,996 | 9/1996 | Reber et al. | 83/56 |
| 5,598,655 | 2/1997 | McGarrah . | |
| 5,599,422 | 2/1997 | Adams, Jr. et al. | 156/510 |
| 5,601,431 | 2/1997 | Howard | 434/79 |
| 5,630,627 | 5/1997 | Stewart | 283/81 |
| 5,658,621 | 8/1997 | Sohn | 428/24 |
| 5,746,451 | 5/1998 | Weyer | 283/65 |
| 5,829,073 | 11/1998 | Lee | 4/661 |

FOREIGN PATENT DOCUMENTS

| | | | |
|---|---|---|---|
| 982819 | 2/1976 | Canada | 40/595 |

*Primary Examiner*—Anthony Knight
*Assistant Examiner*—Marcus Dolce
*Attorney, Agent, or Firm*—Merek & Voorhees

[57] ABSTRACT

The present invention is directed to a system for decorating a picture holder having an original picture, with a removable decorative display. The system includes a picture holder having at least one original picture and a decorative covering. The decorative covering has front and rear surfaces. The front surface of the decorative covering has a decorative display formed thereon in conformity with a particular seasonal or special event. The front surface of the decorative covering is opaque so that when mounted over the original picture, the original picture cannot be seen. The decorative display includes a border area and a pictorial area. The border area has a uniform appearance so that the size of the decorative covering can be readily adjusted to fit at least two different size picture holders. The decorative covering is formed from a material exhibiting static cling thereby permitting the decorative covering to be readily mounted over the original picture. A template is provided to identify where to cut the decorative covering to fit at least two different size picture holders. The template may be formed on the rear surface of the decorative covering or may be formed on a separate sheet such as a protective backing.

19 Claims, 3 Drawing Sheets

APPARATUS FOR DECORATING PICTURE HOLDERS WITH SEASONAL OR OTHER DISPLAYS

FIELD OF THE INVENTION

The present invention is directed to an apparatus for decorating picture holders with seasonal or other types of decorative displays.

BACKGROUND OF THE INVENTION

Special occasions such as the major seasonal events including Christmas, Hanukkah, Halloween, Easter, Thanksgiving, etc. provide individuals with an opportunity to temporarily redecorate various rooms of their living space in a manner consistent with the theme of the particular seasonal event. In addition, other special events such as birthday parties, retirement parties, graduation parties, bridal showers and baby showers, etc. provide individuals with an opportunity to decorate one or more rooms in which the special event is to be held in a manner consistent with the particular special event. One continual problem presented to individuals in decorating a room or rooms of their living space consistent with the theme of a major holiday or other special event are the pictures in the room or rooms throughout the year which are inconsistent with or otherwise out of place for the particular holiday or special event.

Christmas provides an excellent example. In the nineties, more and more individuals have engaged in the ritual of transforming their living space in December to a seasonal delight including elaborate outside and inside displays. The interior decorations include elaborate Christmas trees, manger settings, and numerous accessories bearing Christmas decorative patterns including tablecloths, doormats, pillows, towels, dishes, etc. With such elaborate decorations, a glass framed picture of a bright landscape of a summer day is simply out of place. Similarly, a painting of a vase of peach tulips detracts from the other decorative aspects of the individual's living space carefully tailored to the Christmas holiday.

Previously, individuals have chosen to take down or otherwise remove the out-of-place picture or pictures from the room or rooms and replace it with a picture or decoration more befitting the particular special event or holiday. This process is time consuming because it not only requires removal of the picture but requires the individual to take the time and find the space necessary to safely store the picture until after the special event or holiday. It also requires the individual to find a replacement picture or decoration which is approximately the same size as the picture or pictures removed. Sometimes, individuals have taken down out-of-place pictures and wrapped them like presents to be consistent with the Christmas holiday. This is time-consuming because it requires the picture to be taken down, elaborately wrapped and then rehung. Further, this process must be continually repeated for each special event or holiday. A significant need therefore exists for means to readily redecorate pictures to conform to the theme of the special event or holiday that can be repeatedly reused year after year and which does not require removal of the pictures and subsequent safe storage thereof or other elaborate methods to conform the picture into a decorative accessory befitting the particular special event or holiday.

OBJECTS AND SUMMARY OF THE INVENTION

An object of the present invention is to provide a novel and unobvious device for decorating picture holders to conform to a particular seasonal or special event.

Another object of a preferred form of the present invention is to provide a device which enables individuals to temporarily redecorate picture frames without removing the picture.

A further object of a preferred form of the present invention is to provide a device for redecorating pictures to conform to a particular seasonal or other special event which can be used year after year.

Still a further object of a preferred form of the present invention is to provide a device for redecorating pictures to conform to a particular seasonal or other special event which can be readily sized to fit at least two different size pictures.

Yet another object of a preferred form of the present invention is to provide a device for redecorating pictures to conform to a particular seasonal or other special event which can be readily removed after the event.

Yet still another object of a preferred form of the present invention is to provide a device for redecorating pictures to conform to a particular seasonal or other special event which can be readily stored after use.

A further object of a preferred form of the present invention is to provide a device for redecorating pictures to conform to a particular seasonal or other special event which can be readily secured over an existing picture without the use of an adhesive.

In summary, the present invention, in its preferred form, is directed to a system for decorating a picture holder having an original picture with a removable decorative display. The system includes a picture holder having at least one original picture and a decorative covering. The decorative covering has front and rear surfaces. The front surface of the decorative covering has a decorative display formed thereon in conformity with a particular seasonal or special event. The front surface of the decorative covering is opaque so that when mounted over the original picture, the original picture cannot be seen. The decorative display includes a border area and a pictorial area. The border area has a uniform appearance so that the size of the decorative covering can be readily adjusted to fit at least two different size picture holders. The decorative covering is formed from a material exhibiting static cling thereby permitting the decorative covering to be readily mounted over the original picture. A template is provided to identify where to cut the decorative covering to fit at least two different size picture holders. The template may be formed on the rear surface of the decorative covering or may be formed on a separate sheet such as a protective backing.

DETAILED DESCRIPTION OF THE DRAWINGS

DETAILED DESCRIPTION OF THE PREFERRED EMBODIMENT

The various preferred forms of the present invention will now be described in connection with FIGS. 1 through 8.

FIGS. 1 Through 8

Figure 1:
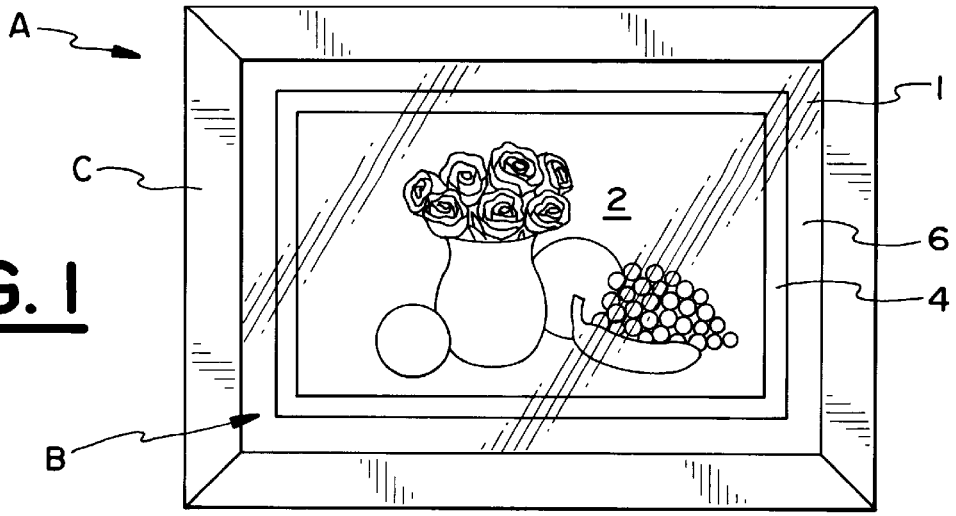
FIG. 1 is a plan view of a picture frame having an original picture mounted under a smooth glass cover.
Figure 2:
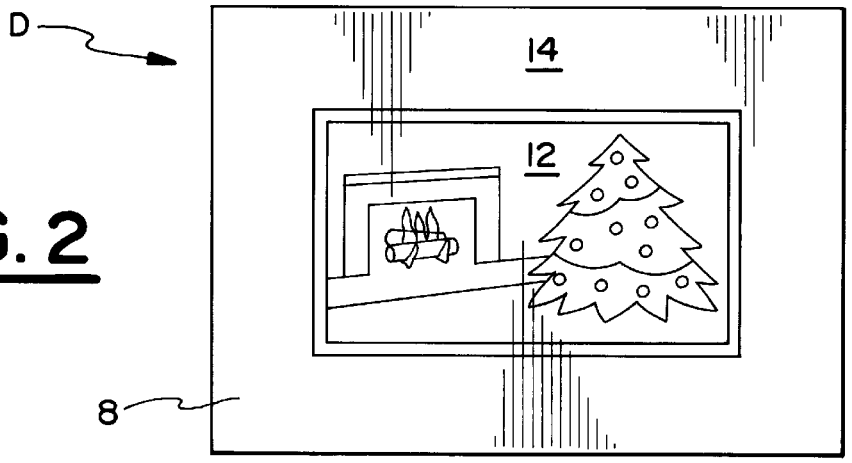
FIG. 2 is a plan view of a decorative covering formed in accordance with a first preferred embodiment of the present invention.
Figure 4:
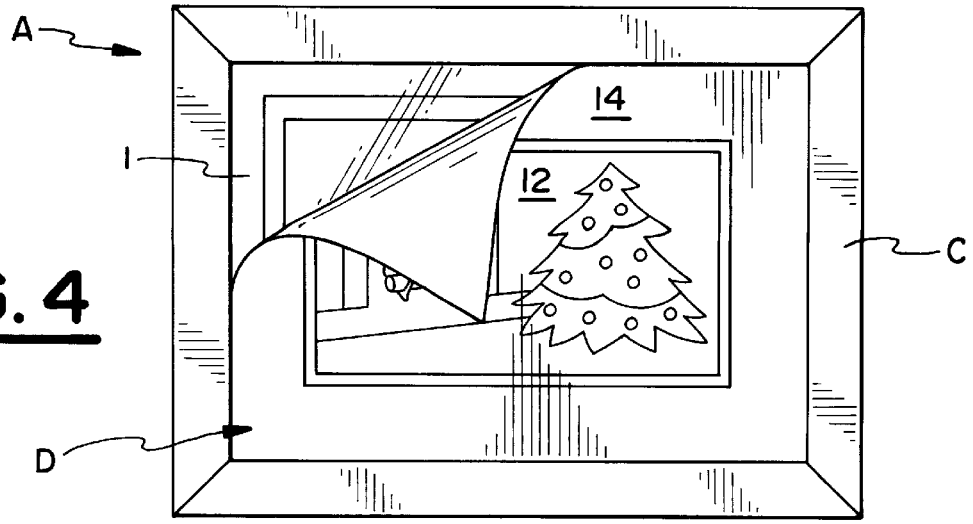
FIG. 4 is a plan view of the picture frame depicted in FIG. 1 with the decorative covering partially installed over the glass cover overlying the original picture of the picture frame.
Figure 3:
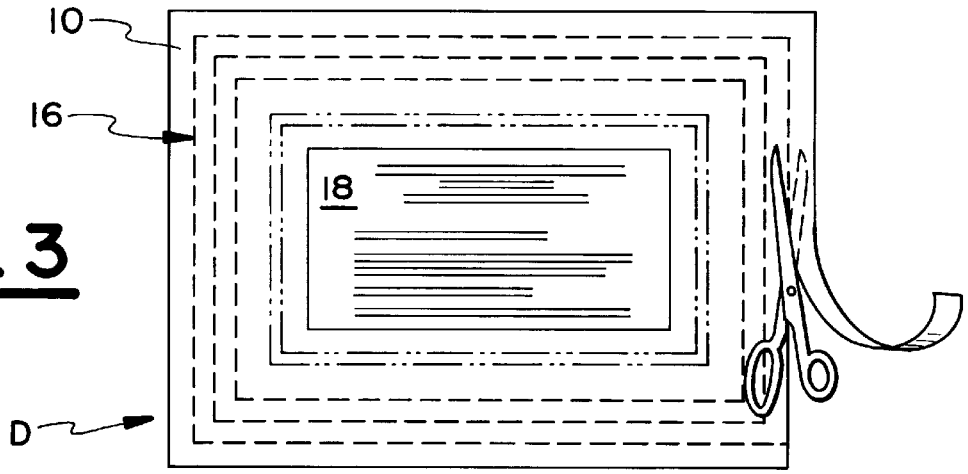
FIG. 3 is a bottom view of a decorative covering formed in accordance with the first preferred embodiment of the present invention.

Referring to FIGS. 1 through 3, the preferred form of the present invention is directed to a system for decorating pictures with a seasonal or other special display. The system includes a picture holder A which includes an original picture B and a frame C. The frame C surrounds a glass cover 1 overlying the original picture B. The term "picture" is used herein in its broadest sense and includes any visual representation or image painted, drawn, photographed or otherwise rendered on a flat surface. Hence, the original picture B includes the artistic pictorial 2 of the vase and the fruit as well as the mattings 4 and 6 which are of a suitable color to match the artistic pictorial. The term holder is similarly used in its broadest sense to include any thing that holds and includes but is not limited to such things as frames of any size, shape or material as well as easels.

A decorative covering D includes a front surface 8, as seen in FIG. 2, and a rear surface 10, as seen in FIG. 3. The front surface 8 includes a decorative display having a pictorial area 12 as well as a uniformed border area 14. More specifically, the pictorial area 12 is a graphic illustration of a setting consistent with the Christmas holiday. However, it must be noted that the pictorial area 12 can be readily varied to conform to any seasonal event including but not limited to Thanksgiving, Easter, Hanukkah, New Years and Halloween. In addition, the pictorial area 12 can be readily varied to conform to any special event including but not limited to birthdays, graduations, retirements, bridal showers and baby showers. The border area 14 is designed to have a uniform appearance. An example of such is a colored border such as green or red to represent Christmas colors. The important aspect is that the border have a uniform appearance so that an individual can cut the border area 14 at any point following the overall shape of the pictorial area 12 without detracting from or substantially altering the form of the decorative display.

The front surface 8 is opaque so that the original picture cannot be seen through the decorative covering D. Further, the decorative covering D is preferably formed from a material exhibiting static cling so that the covering can be readily mounted on numerous surfaces including glass overlying an original picture. The material may be a vinyl formed from a polyvinyl chloride material through a well known manufacturing process. Once again the particular material used can be varied provided that the chosen material exhibits static cling to permit the decorative covering D to be electrostatically adhered over the original picture B. Optionally, a tacky adhesive may be used to secure the decorative covering D to the original picture B.

Figure 7:
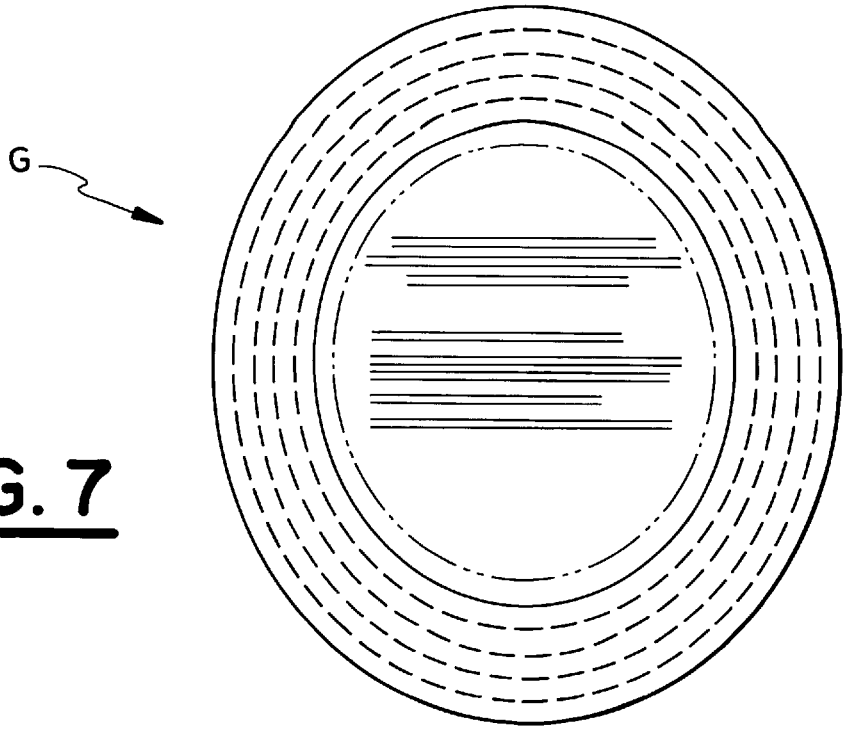
FIG. 7 is a bottom view of a second alternative embodiment of the present invention.

Referring to FIG. 3, the rear surface 10 includes a template 16 and an instruction area 18. The template 16 includes a plurality of sets of dashed lines configured in the form of rectangles. Each of the rectangles has a different area and preferably corresponds to the area of a well known size picture such as a five-inch by seven-inch picture, a six-inch by nine-inch picture, an eight-inch by ten-inch picture or a twelve-inch by fifteen-inch picture, etc. It will be readily appreciated that the dimensions of the template 16 may be varied. Further, it will be readily appreciated that the shape of the sets of dashed lines may be readily varied as illustrated in FIG. 7.

The instruction area 18 includes a step-by-step process for mounting the decorative covering D over an original picture. The preferred form of instructions is as follows:

1. Measure the glass (or other picture covering) area of your existing picture.
2. Trim your Decorative Covering to a size substantially the same as the size of the glass area using the dashed lines as a guide.
3. Clean your glass (or other picture covering) with glass cleaner.
4. Position trimmed Decorative Covering over the glass (or other picture covering).

It will be readily appreciated that the form of the instructions may be readily varied and need not appear on the back of the decorative covering D. Rather, the instructions may be reproduced on a separate sheet.

Figure 5:
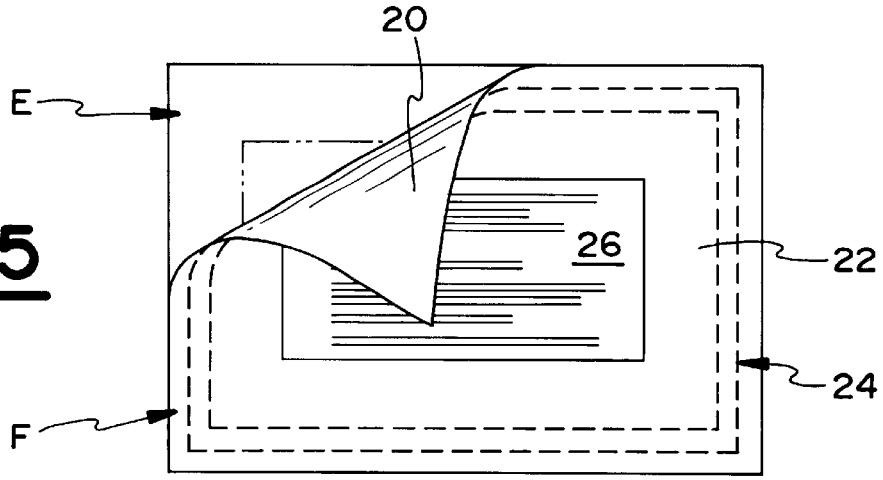
FIG. 5 is a bottom view of a first alternative embodiment of the present invention illustrating a protective backing.

With reference to FIG. 5, a first alternative embodiment will now be described. This embodiment includes a decorative covering E having front and rear surfaces. The front surface takes precisely the same form as the front surface 8 of decorative covering D. The rear surface however differs in that it does not have either a template or an instruction area. Rather, a protective backing F is provided which has a front surface 20 directly adjacent the rear surface of the decorative covering E. The protective backing further has a rear surface 22 with a template 24 and an instruction area 26. The protective backing F may be formed from any material which can be electrostatically adhered to the decorative covering E. Optionally, a tacky adhesive may be used to secure the decorative covering E to the original picture.

Figure 6:
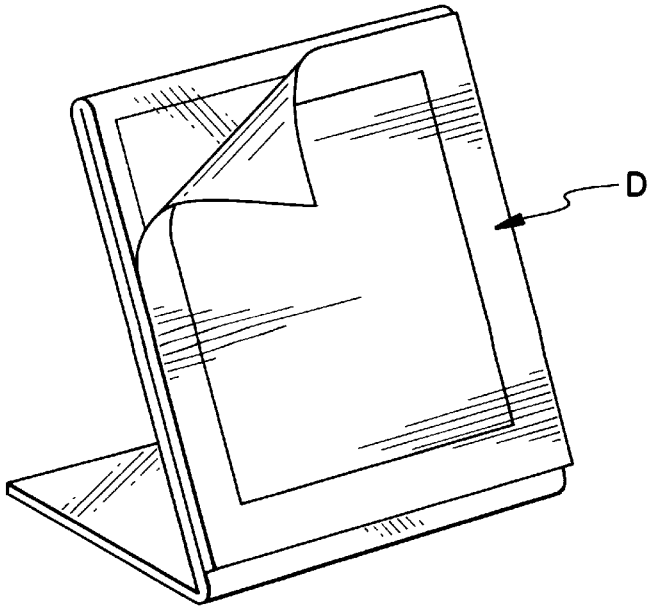
FIG. 6 is a perspective view of an alternative type picture frame to that illustrated in FIG. 1 with a decorative covering partially installed thereover.
Figure 8:
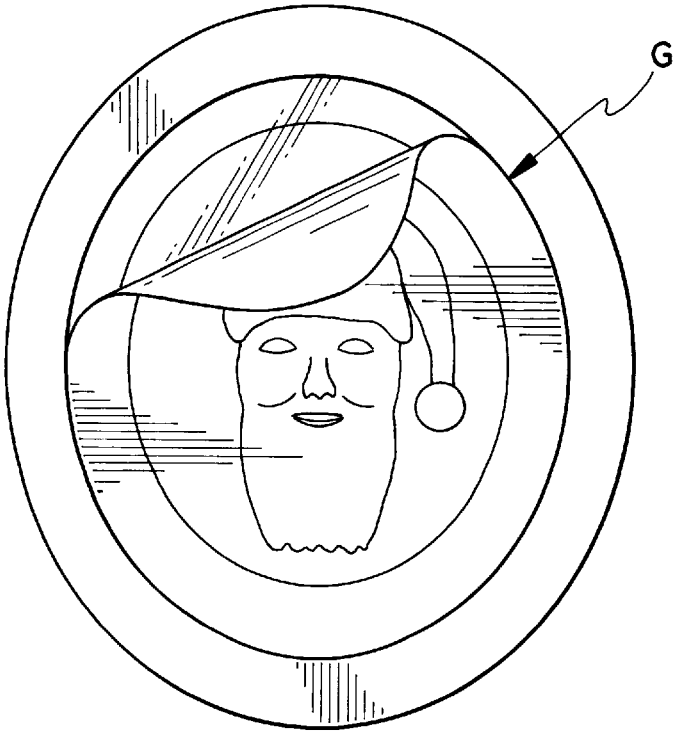
FIG. 8 is a plan view of the second alternative embodiment partially installed over an oval shaped picture frame.

As seen in FIG. 6, the present invention is extremely versatile in that it can be used with numerous different types of picture holders including picture frames that are horizontally supported rather than wall mounted. FIGS. 7 and 8, depict yet another embodiment of the present invention. The decorative covering G is the same as that illustrated in FIGS. 2 through 4 with the sole difference being the shape. It will be readily appreciated that decorative covering G may be provided with a protective backing similar to that depicted in FIG. 5.

While this invention has been described as having various preferred forms, it is understood that it is capable of further modifications, uses and/or adaptions of the invention following in general the principle of the invention and including such departures from the present disclosure as come within the known or customary practice in the art to which the invention pertains and as may be applied to the central features hereinbefore set forth, and fall within the scope of the invention and the limits of the appended claims.

I claim:

1. A decorative picture holder having at least one original picture with a decorative display, comprising:

a) a picture holder having at least one original picture;

b) a first sheet of material having front and rear surfaces;

c) said front surface of said first sheet of material having a decorative display formed thereon, said front surface further being opaque so that at least a portion of the original picture covered by said first sheet of material cannot be seen through said first sheet of material; and, d) a template identifying where to cut said first sheet of material to fit at least two different size picture holders, said first sheet of material being of a sufficient size such that when cut to a particular size picture holder using said template a cut segment of said first sheet of material forms a single piece which overlies completely of the original picture.

2. The decorative picture holder as set forth in claim 1, wherein:

a) said template is formed on said rear surface of said first sheet of material.

3. The decorative picture holder as set forth in claim 1, wherein:

a) said first sheet of material is formed from a material exhibiting static cling thereby permitting said first sheet of material to be removably adhered to at least a portion of said picture holder.

4. The decorative picture holder as set forth in claim 1, wherein:

a) said decorative display includes a border area and a pictorial area, said border area has a uniform appearance so that said first sheet of material can be readily sized to fit at least two different size picture holders.

5. A system as set forth in claim 1, wherein:

a) said original picture is a photograph.

6. The decorative picture holder as set forth in claim 1, wherein:

a) said first sheet of material has a size and shape substantially equal to a size and share of said original picture.

7. An apparatus for decorating a picture holder with a removable decorative display, comprising:

a) a first sheet of material having front and rear surfaces, said front surface of said first sheet of material having a decorative display formed thereon, at least a portion of said front surface being opaque;

b) said first sheet of material being formed from a plastic material exhibiting static cling thereby permitting the first sheet of material to be removably adhered to a portion of a picture holder; and, c) a second sheet of material overlying at least a section of said first sheet of material, said second sheet of material including front and rear surfaces, said front surface of said second sheet of material being in abutting relationship with said rear surface of said first sheet of material, said rear surface of one of said first and second sheets of materials having a template formed thereon to identify where to cut said first sheet of material to fit at least two different size picture holders, said template including first indicia forming a first boundary to cut along, said template further including second indicia forming a second boundary to cut along, said first boundary being disposed inside of said second boundary.

8. The apparatus as set forth in claim 7, wherein:

a) said template is formed on said rear surface of said second sheet of material.

9. The apparatus as set forth in claim 7, wherein:

a) said template is formed on said rear surface of said first sheet of material.

10. The apparatus as set forth in claim 7, wherein:

a) said decorative display includes a border area and a pictorial area, said border area has a uniform appearance so that said first sheet of material can be readily sized to fit at least two different size picture holders.

11. The apparatus as set forth in claim 7, wherein:

a) said first sheet of material is sufficiently sized to overlie completely an original picture of a picture holder.

12. A decorative picture holder having an original picture with a removable decorative display, comprising:

a) a picture holder having at least one original picture;

b) a decorative covering having front and rear surfaces, said front surface of said decorative covering having a decorative display formed thereon, said front surface of said decorative covering further being opaque;

c) said decorative covering being formed from a material exhibiting static cling thereby permitting said decorative covering to be removably adhered over the original picture of said picture holder; and, d) a protective backing overlying at least a portion of said decorative covering, said protective backing including front and rear surfaces, said front surface of said protective backing being in abutting relationship with said rear surface of said decorative covering; and, e) said rear surface of said protective backing having a template formed thereon to identify where to cut said decorative covering to fit at least two different size picture holders.

13. The decorative picture holder as set forth in claim 12, wherein:

a) said decorative display includes a border area and a pictorial area, said border area has a uniform appearance so that said first sheet of material can be readily sized to fit at least two different size picture holders.

14. The decorative picture holder as set forth in claim 12, wherein:

a) said decorative covering has a shape substantially identical to a shape of said original picture.

15. The decorative picture holder as set forth in claim 12, wherein:

a) said decorative covering has a size substantially equal to a size of said original picture.

16. The decorative picture holder as set forth in claim 12, wherein:

a) said decorative covering is sufficiently sized to cover completely said original picture.

17. The decorative picture holder as set forth in claim 12, wherein:

a) said decorative covering is substantially rectangular in shape.

18. The decorative picture holder as set forth in claim 12, wherein:

a) said decorative display is a holiday display.

19. The decorative picture holder as set forth in claim 12, wherein:

a) said template includes indicia identifying where to cut said decorative covering to fit over a five-inch by seven-inch original picture, a six-inch by nine-inch original picture and a twelve-inch by fifteen-inch original picture.

* * * * *